US009808949B2

(12) United States Patent
Hori et al.

(10) Patent No.: US 9,808,949 B2
(45) Date of Patent: Nov. 7, 2017

(54) TRIMMER

(75) Inventors: Takakazu Hori, Takashima (JP); Kazuo Miyagawa, Takashima (JP); Tomonori Yachi, Takashima (JP)

(73) Assignee: HORIZON INTERNATIONAL INC., Shiga (JP)

( * ) Notice: Subject to any disclaimer, the term of this patent is extended or adjusted under 35 U.S.C. 154(b) by 177 days.

(21) Appl. No.: 14/395,729

(22) PCT Filed: May 29, 2012

(86) PCT No.: PCT/JP2012/063713

§ 371 (c)(1),
(2), (4) Date: Oct. 20, 2014

(87) PCT Pub. No.: WO2013/179380

PCT Pub. Date: Dec. 5, 2013

(65) Prior Publication Data

US 2015/0075344 A1 Mar. 19, 2015

(51) Int. Cl.
*B26D 5/20* (2006.01)
*B23D 25/02* (2006.01)
(Continued)

(52) U.S. Cl.
CPC ..... *B26D 5/08* (2013.01); *B26D 1/08* (2013.01); *B26D 5/02* (2013.01); *B26D 7/02* (2013.01);
(Continued)

(58) Field of Classification Search
CPC ... B26D 5/08; B26D 5/02; B26D 7/02; B26D 1/08; B26D 2007/0081; B26D 2007/0056; Y10T 83/8736
(Continued)

(56) References Cited

U.S. PATENT DOCUMENTS 2,208,350 A * 7/1940 Ungar ..... B23D 36/0041 83/298
3,122,041 A * 2/1964 Kile ..... B26D 1/09 83/155
(Continued)

FOREIGN PATENT DOCUMENTS

EP 1018408 A1 7/2000
JP 2003-71779 A 3/2003
(Continued)

OTHER PUBLICATIONS

Search Repport dated Mar. 9, 2016, issued in counterpart European Application No. 12878178.8 (3 pages).
(Continued)

*Primary Examiner* — Ghassem Alie
*Assistant Examiner* — Bharat C Patel
(74) *Attorney, Agent, or Firm* — Westerman, Hattori, Daniels & Adrian, LLP

(57) ABSTRACT

An edge portion of a bound material is provided with first and second lines. The first and second lines are spaced at a small interval and arranged in parallel to each other. The first line is arranged outside of the second line of the bound material. A control unit controls first and second drive mechanisms in such a manner that the edge portion of the bound material is cut at the first line by a trim cutter, then the trim cutter or the table is moved at the small interval in a moving direction toward the second line, and then the edge portion of the bound material is cut at the second line by the trim cutter.

8 Claims, 8 Drawing Sheets

(51) Int. Cl.

| | |
|---|---|
| ***B26D 5/08*** | (2006.01) |
| ***B26D 1/08*** | (2006.01) |
| ***B26D 7/02*** | (2006.01) |
| ***B26D 5/02*** | (2006.01) |
| ***B26D 7/06*** | (2006.01) |
| *B26D 7/00* | (2006.01) |
| *B26D 7/01* | (2006.01) |

(52) U.S. Cl.
CPC ..... *B26D 7/0675* (2013.01); *B26D 7/016* (2013.01); *B26D 7/018* (2013.01); *B26D 7/025* (2013.01); *B26D 2007/0056* (2013.01); *B26D 2007/0081* (2013.01); *Y10T 83/8736* (2015.04)

(58) Field of Classification Search
USPC ..... 83/934, 327, 341, 636, 651, 657, 401, 83/404, 404.4, 404.2, 703–708, 409, 206, 83/207, 409.1, 732, 411.7, 452; 270/52.17
See application file for complete search history.

(56) References Cited

U.S. PATENT DOCUMENTS

| | | | | | |
|---|---|---|---|---|---|
| 3,722,336 | A * | 3/1973 | Sarring | B26D 7/0625 | 83/155 |
| 3,884,102 | A * | 5/1975 | Faltin | B26D 1/245 | 83/152 |
| RE28,840 | E * | 6/1976 | Sarring | B26D 7/0625 | 83/155 |
| 4,606,387 | A * | 8/1986 | Weislogel | B26D 7/0675 | 144/2.1 |
| 4,922,773 | A * | 5/1990 | Ito | B26D 1/09 | 198/345.1 |
| 6,193,458 | B1 * | 2/2001 | Marsh | B26D 5/02 | 412/1 |
| 6,506,008 | B2 * | 1/2003 | Merkli | B26D 1/09 | 270/52.17 |
| 6,520,058 | B2 * | 2/2003 | Nakajima | B26D 1/09 | 83/206 |
| 6,536,319 | B1 * | 3/2003 | Boss | B26D 1/09 | 83/247 |
| 6,796,209 | B2 * | 9/2004 | Boss | B26D 5/22 | 83/365 |
| 7,014,182 | B2 * | 3/2006 | Marsh | B26D 5/02 | 270/1.01 |
| 7,077,042 | B2 * | 7/2006 | Nogawa | B26D 7/025 | 83/466 |
| 7,493,840 | B2 * | 2/2009 | Yamaguchi | B26D 5/16 | 83/276 |
| 7,503,555 | B2 * | 3/2009 | Dobrovolsky | B41F 17/02 | 270/1.01 |
| 7,533,596 | B2 * | 5/2009 | Rathert | B26D 7/025 | 83/404.1 |
| 8,167,293 | B2 * | 5/2012 | Lewalski | B26D 7/0641 | 270/52.17 |
| 2002/0148335 | A1 * | 10/2002 | Gross | B26D 7/015 | 83/91 |
| 2003/0079584 | A1 * | 5/2003 | Cote | B26D 1/09 | 83/13 |
| 2003/0145703 | A1 * | 8/2003 | Rohe-Krebeck | B26D 7/015 | 83/277 |
| 2004/0020340 | A1 * | 2/2004 | Burke | B26D 1/0006 | 83/613 |
| 2004/0112195 | A1 * | 6/2004 | Lorenzi | B26D 1/09 | 83/546 |
| 2005/0016345 | A1 * | 1/2005 | Lorenzi | B26D 1/09 | 83/151 |
| 2008/0310935 | A1 * | 12/2008 | Hommochi | B26D 1/08 | 412/1 |
| 2011/0044786 | A1 * | 2/2011 | Marsh | B26D 1/08 | 412/1 |

FOREIGN PATENT DOCUMENTS

| | | | |
|---|---|---|---|
| JP | 2004-66347 | A | 3/2004 |
| JP | 2005-161448 | A | 6/2005 |
| JP | 2008-068352 | A | 3/2008 |
| JP | 2008-307617 | A | 12/2008 |

OTHER PUBLICATIONS

International Preliminary Report on Patentability (Form PCT/IB/373) of International Application No. PCT/JP2012/063713 dated Dec. 2, 2014, with Form PCT/ISA/237 (5 pages).
International Search Report dated Sep. 4, 2012 issued in corresponding application No. PCT/JP2012/063713.

* cited by examiner

TRIMMER

TECHNICAL FIELD OF THE INVENTION

The present invention relates to a trimmer constructed so as to trim each of top, bottom and front edge portions of a bound material during a finish processing of a book binding process.

BACKGROUND OF THE INVENTION

A conventional trimmer is described in Patent Document 1 (JP 2004-066347 A). The trimmer comprises a single trim cutter reciprocated in a vertical direction between a non-cutting position and a cutting position, and a table for positioning the bound material placed thereon. In this conventional trimmer, an operator puts the bound material on the table and positions it, and then the trim cutter is moved from the non-cutting position to the cutting position so as to cut an edge portion of the bound material. The operator rotates and positions the bound material at each of top, bottom and front edge cutting positions, sequentially. The operator reciprocates the trim cutter at each of the positions so as to cut each of the top, bottom and front edge portions. Thus, each of the edge portions of the bound material is trimmed.

Another conventional trimmer described in Patent Document 2 (U.S. Pat. No. 7,493,840 B) is a three-side trimmer. The three-side trimmer comprises a single trim cutter reciprocated in a vertical direction between a non-cutting position and a cutting position, a table for positioning a bound material placed thereon, and a rotate mechanism for rotating the table. A feed mechanism supplies the bound material on the table, and the table with the bound material is rotated so as to position the bound material at each of top, bottom and front edge cutting positions by the rotate mechanism. Then, the trim cutter reciprocates at each of the positions to cut the top, bottom and front edge portions.

In the above described conventional trimmer, the trim cutter reciprocates only once so as to cut the edge portion of the bound material. In case of FIG. 7, the edge portion 1*a* of the bound material 1 to be cut is long. In this case, when the edge portion 1*a* of the bound material 1 is cut by the trim cutter 20 only once, there is a possibility that the edge portion 1*a* of the bound material 1 may be bent, or a cover 1*f* of the bound material 1 may be torn. In case of FIG. 8, each of pages of the bound material 1 is an uncut page ("signature"), which is half folded, and the folded line 1*g* of the uncut pages must be cut. In this case, when the edge portion 1*a* (the folded line 1*g*) of the bound material 1 is cut by the trim cutter 20 only once, the edge portion 1*a* of the bound material 1 is not trimmed neatly. The conventional trimmer cannot trim the edge portion 1*a* of the bound material 1 neatly.

Patent Document 1: JP 2004-066347 A

Patent Document 2: U.S. Pat. No. 7,493,840 B

SUMMARY OF THE INVENTION

Problems to be Solved by the Invention

It is an object of the present invention to provide a trimmer which can cut the edge portion of the bound material neatly without bending the edge portion of the bound material and tearing the cover of the bound material.

Solution to the Problems

In order to achieve the object, the present invention provides a trimmer for trimming an edge portion of a bound material. The trimmer comprises a table for supporting the bound material; a trim cutter for cutting the edge portion of the bound material; and a frame for supporting the trim cutter. The trimmer further comprises a first drive mechanism for reciprocating the trim cutter in a vertical direction between a cutting position and a non-cutting position; a second drive mechanism for moving the trim cutter or the table in a moving direction perpendicular to a length direction of the trim cutter; and a control unit for controlling operations of the first and second drive mechanisms. The edge portion of the bound material is provided with first and second lines to be cut. The first and second lines are spaced at a small interval and arranged in parallel to each other. The first line is arranged outside of the second line of the bound material. And, the control unit controls the first and second drive mechanisms in such a manner that the edge portion of the bound material is cut at the first line by the trim cutter, then the trim cutter or the table is moved at the small interval in the moving direction toward the second line, and then the edge portion of the bound material is cut at the second line by the trim cutter.

According to a preferred embodiment of the present invention, the trimmer is a three-side trimmer, and rotates the table so as to position the bound material at each of top, bottom and front edge cutting positions, and cuts a top edge portion of the bound material at the top edge cutting position, a bottom edge portion of the bound material at the bottom edge cutting position and a front edge portion of the bound material at the front edge cutting position. And, the control unit controls the first and second drive mechanisms in such a manner that at least the top and bottom edge portions of the bound material are cut at the first and second lines.

According to a preferred embodiment of the present invention, the second drive mechanism moves not the table but the trim cutter in the moving direction.

According to a preferred embodiment of the present invention, the second drive mechanism comprises a feed screw engaged with the frame and extending in the moving direction, and a motor for rotating the feed screw. And, the control unit controls a rotation of the motor in such a manner that the trim cutter is positioned at the first and second lines.

According to a preferred embodiment of the present invention, the small interval is 2 to 3 mm.

According to a preferred embodiment of the present invention, the trimmer further comprises a touch screen for receiving input of a value of the small interval. The control unit controls the second drive mechanism based on the value of the small interval inputted through the touch screen.

EFFECT OF THE INVENTION

As above described, the trimmer according to the present invention comprises the first drive mechanism for reciprocating the trim cutter in the vertical direction between the cutting position and the non-cutting position, the second drive mechanism for moving the trim cutter or the table in the moving direction perpendicular to the length direction of the trim cutter, the control unit for controlling the operations of the first and second drive mechanisms. The edge portion of the bound material is provided with the first and second lines to be cut. The first and second lines are spaced at a small interval and arranged in parallel to each other. The first line is arranged outside of the second line of the bound material.

The control unit controls the first and second drive mechanisms in such a manner that the edge portion of the bound material is cut at the first line by the trim cutter, then the trim cutter or the table is moved at the small interval in the moving direction toward the second line, and then the edge portion of the bound material is cut at the second line by the trim cutter.

As above described, at first the trimmer cuts the edge portion of the bound material at the first line arranged outside of the second line of the bound material. The edge portion of the bound material which was cut at the first line might be bent or torn. Then, the trim cutter or the table is moved at the small interval in the moving direction. And then, further the edge portion of the bound material is cut at the second line. Thus, the edge portion of the bound material which was cut at the first line is further cut at the second line. The trim cutter or the table is moved at the small interval in the moving direction, and the trim cutter is reciprocated in the vertical direction between the cutting position and the non-cutting position. As a result, the edge portion of the bound material bent or torn through the first cut is removed through the second cut. Thereby, the edge portion of the bound material is trimmed neatly.

DETAILED EXPLANATION OF THE PREFERRED EMBODIMENTS

A trimmer according to the present invention will be explained hereinbelow with reference to the figures.

[First Embodiment]

[Structure]

Figure 1:
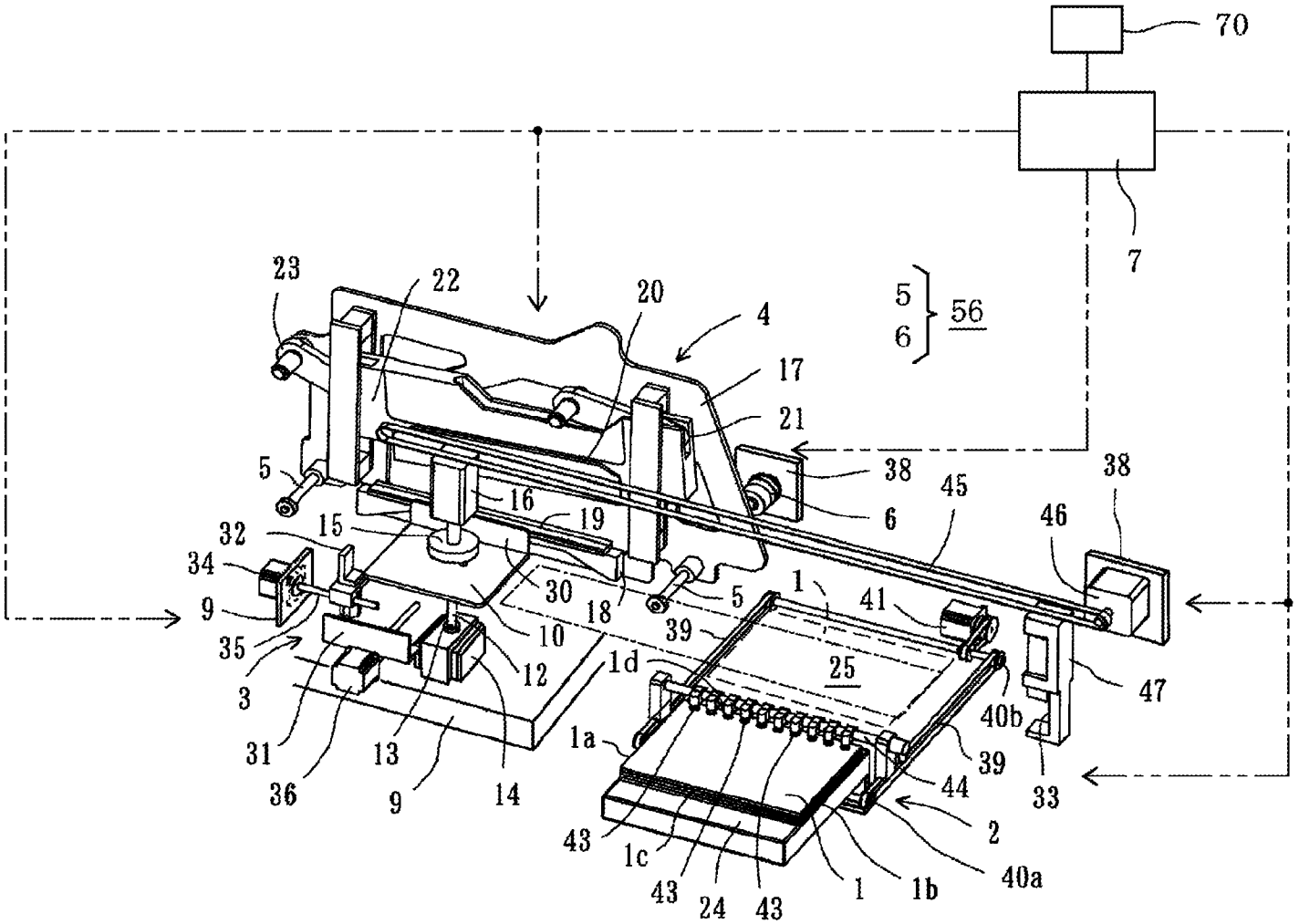
FIG. 1 is a schematic perspective view showing a trimmer according to a first embodiment of the present invention before a bound material is fed from a bound material feed unit of a bound material load table.
Figure 2:
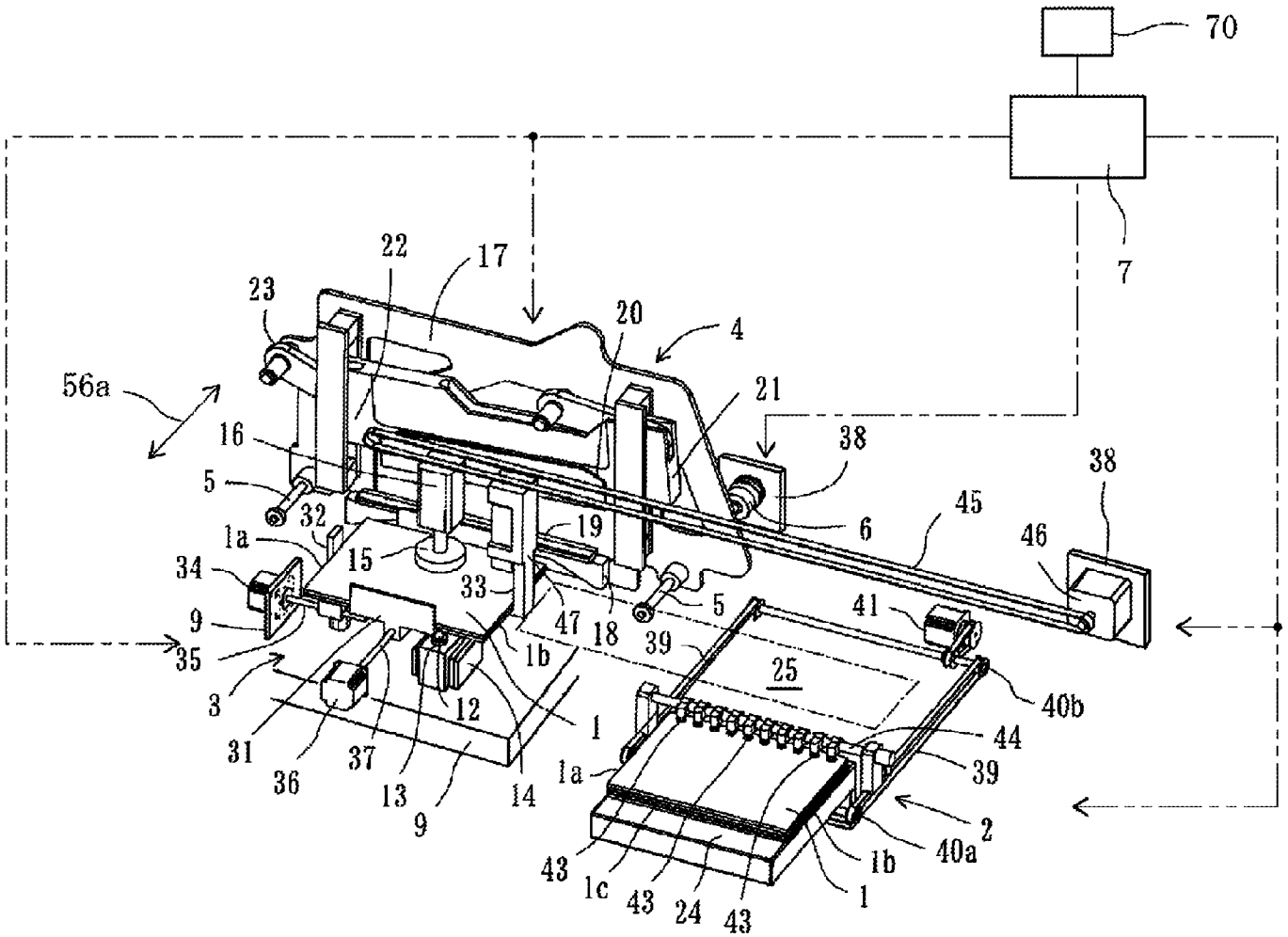
FIG. 2 is a schematic perspective view showing the trimmer of FIG. 1 in which the bound material is positioned on a table of a table unit.

Referring to FIGS. 1 and 2, a structure of the trimmer will be explained.

The trimmer comprises a bound material feed unit 2 for feeding a bound material 1 one by one, a table unit 3 receiving the bound material 1 from the bound material feed unit 2 thereon at a predetermined position and rotatable with the bound material 1 at every predetermined angle in such a manner that the bound material 1 is positioned at each of top, front and bottom edge cutting positions, and a trim unit 4 arranged for movement in directions toward and away from the table unit 3. During such movement, the trim unit 4 is arranged at a stand-by position away from the table unit 3, directly above a first line 100 to be cut on the bound material 1, and directly above a second line 101 to be cut on the bound material 1. The first and second lines are provided on a top edge portion 1*a*, a bottom edge portion 1*b* and a front edge portion 1*c* of the bound material 1, respectively.

The bound material feed unit 2 has a bound material load table 24 on which a stack of the bound materials 1 is placed. A path 25 for transporting the bound material 1 extends between the table unit 3 and the bound material load table 24. A discharge end of the path 25 is adjacent to the table unit 3, while a side section of a supply end thereof is adjacent to the bound material load table 24.

The bound material feed unit 2 also has a bound material feed mechanism which feeds the bound material 1 from the bound material load table 24 to the path 25 one by one. The bound material feed mechanism has a pair of endless belts 39 extending across and perpendicularly to the path 25 from both sides of the bound material load table 24, and rollers 40*a* and 40*b* between which the endless belts 39 are extended. A support bar 44 having substantially a reverse U-shape is fixed to the pair of the endless belts 39. A plurality of suction heads 43 is mounted on the support bar 44 and faces downward. Suction heads 43 are spaced in a length direction of the support bar 44. In this way, the line of the suction heads 43 reciprocates between the bound material load table 24 and the path 25 in a direction perpendicular to the path 25 by a drive of a motor 41.

The bound material feed unit 2 also has a bound material transport mechanism which transports the bound material 1 received from the bound material feed mechanism on the path 25 to the table unit 3 along the path 25. The bound material transport mechanism has an endless belt 45 extending along and above the path 25 and rotatably supported by a frame 38. The endless belt 45 is rotatably driven by a motor 46 mounted to the frame 38. A chuck 47 is hung with the endless belt 45 and reciprocates between the bound material load table 24 and the table 10 on the path 25 by the drive of the motor 46.

As described above, the bound material 1 placed on the bound material load table 24 is absorbed one by one by the line of the suction heads 43, and then, it is fed in the direction perpendicular to the transporting direction of the bound material 1 to the path 25 in which its back 1*d* faces forward. The bound material 1 is gripped by the chuck 47 at this position. At this time, the face 33 of the chuck 47 comes in contact with the bottom edge 1*b* of the bound material 1. Then, the absorption by the line of the suction heads 43 is released, whereby the bound material 1 is transferred to the chuck 47. Thereafter, the chuck 47 moves toward the table unit 3 on the path 25, and when the top edge 1*a* of the bound material 1 comes in contact with the second upright plate 32, it stops. Thus, the bound material 1 is positioned on the table 10 in the top-to-bottom direction.

The table unit 3 has a base 9 and a rectangular table 10 which is provided with the top surface for supporting a bottom surface of a section of the bound material 1 except for the top edge portion 1*a*, the bottom edge portion 1*b* and the front edge portion 1*c* thereon. The table unit 3 also has positioning means for positioning the bound material 1 on the top surface of the table 10.

In this embodiment, the positioning means has a first upright plate 30 arranged on one side edge of the table 10, wherein a back 1*d* of the bound material 1 comes in contact with the upright plate 30. The first upright plate 30 is coupled to a slide drive mechanism (not shown) attached to the bottom surface of the table 10. Further, the positioning means has a second upright plate 32 to which the top edge 1*a* of the bound material 1 can contact. The second upright plate 32 is mounted on a feed screw 35 that is rotatably driven by a motor 34 supported by the base 9. In this way, the first and second upright plates 30 and 32 move in directions toward and away from the table 10 and they stop at a predetermined position corresponding to both of a size and a receive position of the bound material 1 fed from the bound material feed unit 2 (see FIG. 1).

The positioning means is further provided with a third upright plate 31 arranged opposite to the first upright plate 30 with the table 10 therebetween, so that the front edge 1*c* of the bound material 1 comes in contact with the third upright plate 31. The third upright plate 31 is mounted on a feed screw 37 which is rotatably driven by a motor 36 supported by the base 9, like the second upright plate 32, so that it moves in directions toward and away from the table 10. When the bound material 1 is placed on the table 10, the third upright plate 31 moves in a direction toward the bound material 1 until the back 1*d* of the bound material 1 comes in contact with the first upright plate 30 and the third upright plate 31 comes in contact with the front edge 1*c*. This achieves the positioning of the bound material 1 placed on the table 10 in the back-to-front direction (see FIG. 2).

The face 33 of the chuck 47 of the bound material feed unit 2 that comes in contact with the bottom edge 1*b* of the bound material 1 also functions as a part of the positioning means. It performs the positioning of the bound material 1 in the top-to-bottom direction with the second upright plate 32 (see FIG. 2).

A vertical shaft 12 is mounted on the bottom surface of the table 10 and the shaft 12 is held so as to be rotatable by a bearing 13 mounted to the base 9. A motor 14 is coupled to the shaft 12, whereby the table 10 is rotatably driven by the motor 14.

A pressure plate 15 is arranged opposite to the shaft 12 above the table 10 for upwardly and downwardly movement between two positions of a stand-by position at which it is spaced from the bound material 1, and a pressure position at which it presses the bound material 1 against the table 10. The pressure plate 15 is mounted to a piston-cylinder device 16 supported by the base 9 such that it can rotate at the pressure position with the table 10 and the bound material 1. It is reciprocated between the stand-by position and the pressure position by the drive of the piston-cylinder device 16.

After the bound material 1 is positioned by the positioning means 30, 31, 32 and 33, the pressure plate 15 moves to the pressure position to fix the bound material 1 to the table 10. After the pressure plate 15 is disposed on the pressure position, the third upright plate 31 and the chuck 47 (the face 33) of the positioning means are separated from the bound material 1 in order not to obstruct the rotational movement of the bound material 1.

The trim unit 4 has a frame 17. An additional table 18 is attached to the frame 17. When the trim unit 4 is disposed directly above the first and second lines 100 and 101, the additional table 18 supports the bottom surface of the top edge portion 1*a*, the bottom edge portion 1*b* or the front edge portion 1*c* of the bound material 1 placed on the table 10 of the table unit 3. A blade receive plate 19 is fixed to the top surface of the additional table 18.

A trim cutter 20 is arranged opposite to the blade receive plate 19 above the additional table 18 for upwardly and downwardly movement. The trim cutter 20 takes two positions of a non-cutting position at which it is spaced from the blade receive plate 19 and a cutting position at which it is pushed against the blade receive plate 19 at its edge. A first drive mechanism 21 is attached to the frame 17 for reciprocating the trim cutter 20 between the cutting position and the non-cutting position.

A pressure member 22 is arranged above the additional table 18 for upwardly and downwardly movement between two positions of a non-pressing position at which it is spaced from the bound material 1 and a pressing position at which it presses the bound material 1 against the additional table 18. The pressure member 22 is reciprocated between the non-pressing position and the pressing position by a pressure member drive mechanism 23. The pressure member 22 is disposed on the pressing position when the trim cutter 20 moves from the non-cutting position to the cutting position, while the pressure member 22 is disposed on the non-pressing position when the trim cutter 20 moves from the cutting position to the non-cutting position.

Two feed screws 5 are horizontally arranged between the table unit 3 and the trim unit 4, and they 5 are spaced from each other. The feed screws 5 are rotatably mounted to a support member (not shown) fixed to another frame (main frame) 38. The frame 17 of the trim unit 4 is engaged with the feed screws 5. The feed screws 5 are coupled to a driving shaft of a motor 6 mounted on the frame 38, whereby the feed screws 5 are rotatably driven by the motor 6. A second drive mechanism 56 is composed of the feed screws 5 and the motor 6. The second drive mechanism 56 causes the trim unit 4 to move between three positions of the first and second lines and the stand-by position along the axis direction of the feed screws 5.

There is provided a control unit 7 for controlling the operations of the table unit 3, the trim unit 4 and the second drive mechanism 56 (the motor 6). The control unit 7 controls them in such a manner that the trim unit 4 moves from the stand-by position to the first and second lines every time the bound material 1 is arranged at the top edge cutting position, the front edge cutting position and the bottom edge cutting position, to cut the top edge portion 1*a*, the front edge portion 1*c* and the bottom edge portion 1*b* of the bound material 1, respectively. A touch screen 70 is further connected to the control unit 7, by which an operator can set up the table unit 3, the trim unit 4 and the second drive mechanism 56 (the motor 6).

[Trimming Process]

Referring to FIGS. 3 to 5, a process for trimming the top edge portion 1*a* of the bound material 1 will be explained.

As shown in FIGS. 3 and 4, the top edge portion 1*a* of the bound material 1 is provided with the first and second lines 100 and 101 to be cut. The first line 100 is arranged outside of the second line 101 of the bound material 1. The first and second lines 100 and 101 are arranged in parallel to each other and spaced at a predetermined small interval X. The small interval X is 1 to 5 mm, preferably 2 to 3 mm. The top edge portion 1*a* of the bound material 1 is cut at both of the first and second lines 100 and 101 by the trim cutter 20.

Figure 5A:
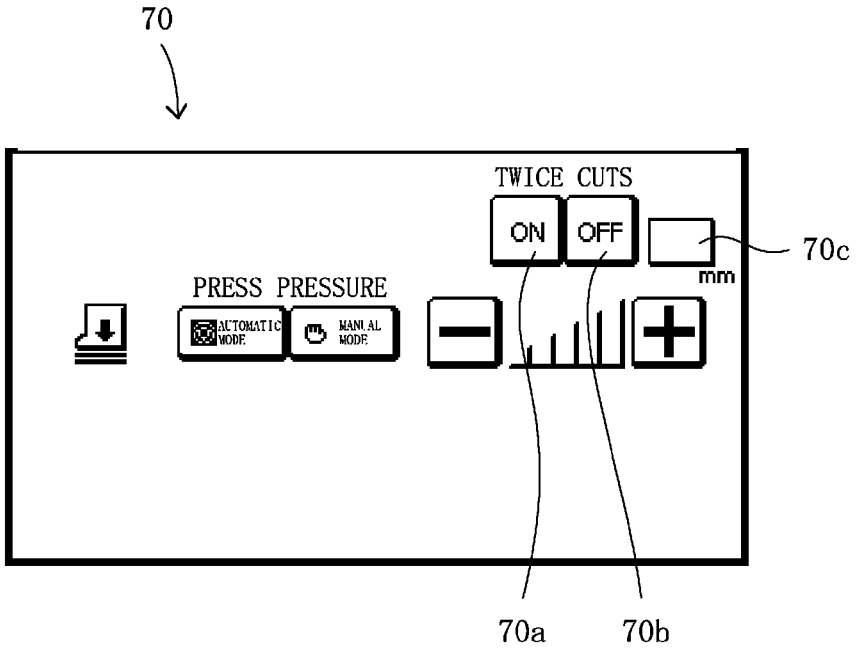
FIG. 5A is a front view showing a first set screen displayed on a touch screen.

As shown in FIG. 5A, an operator can select an operation of "once cut" or "twice cuts" via a first set screen displayed on the touch screen 70. When an "on" button displayed on the first set screen is pressed (the operations of "twice cuts" is selected), the control unit 7 is set in such a manner that the bound material 1 is cut at both of the first and second lines 100 and 101 by the trimming cutter 20. When an "off" button displayed on the first set screen is pressed (the operation of "once cut" is selected), the control unit 7 is set in such a manner that the bound material 1 is cut only at the first line 100 by the trimming cutter 20. A value of the small interval X (for example 2.0 mm) is inputted into a column 70*c* of the first set screen.

Figure 5B:
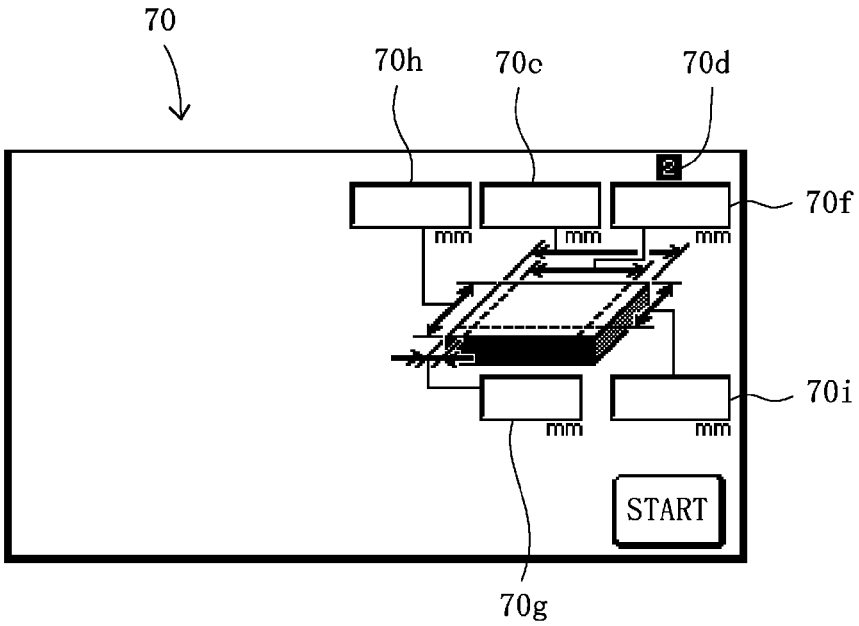
FIG. 5B is a front view showing a second set screen displayed on the touch screen.

As shown in FIG. 5B, when a second set screen is displayed on the touch screen 70, a width (a distance between the top and bottom edge portions 1*a* and 1*b*) of the bound material 1 before cut is inputted into a column 70*e* of the second set screen. Meanwhile, a width (a distance between the top and bottom edge portions 1*a* and 1*b*) of the bound material 1 after cut can be inputted into a column 70*f* of the second set screen. A length of the top edge portion 1*a* of the bound material 1 to be cut is inputted into a column 70*g* of the second set screen. A length (a distance between the front edge portion 1*c* and the back 1*d*) of the bound material 1 before cut is inputted into a column 70*h* of the second set screen. A length (a distance between the front edge portion 1*c* and the back 1*d*) of the bound material 1 after cut is inputted into a column 70*i* of the second set screen.

After the "on" button 70*a* of the first set screen is pressed, the "on" button 70*a* is highlighted and a character "2" (70*d*) is displayed above the column 70*f* of the second set screen, as a result an operator can easily confirm that the operation of the "twice cuts" is selected. After the "off" button 70*b* of the first set screen is pressed, the "off" button 70*b* is highlighted and a character "1" is displayed above the column 70*f* of the second set screen, as a result an operator can easily confirm that the operation of the "once cut" is selected.

Figure 3A:
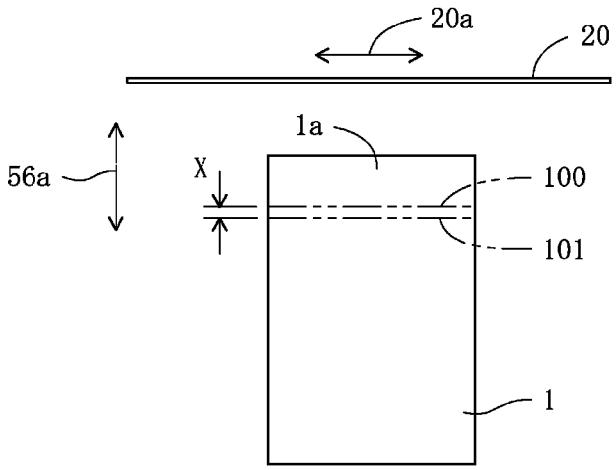
FIG. 3A is a plan view illustrating a trimming process of the trimmer according to the present invention in which a trim cutter is disposed at a stand-by position.
Figure 4A:
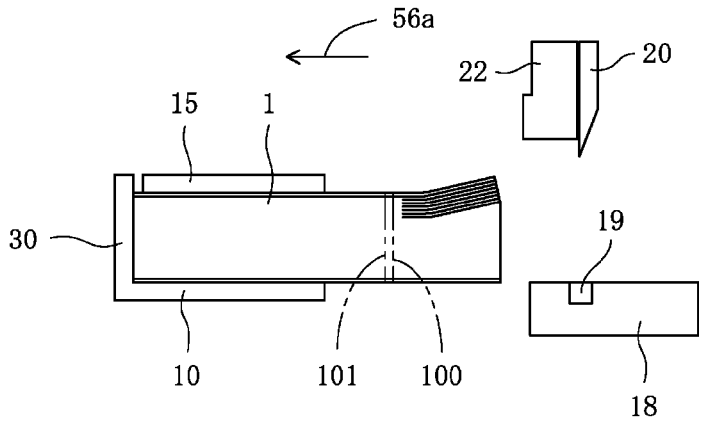
FIG. 4A is a side view illustrating the trimming process of the trimmer according to the present invention in which the trim cutter is disposed at the stand-by position.

At first, as shown in FIG. 3A, the table unit 3 rotates the table 10 in such a manner that an edge of the top edge portion 1*a* of the bound material 1 is arranged in parallel to a length direction 20*a* of the trim cutter 20 and the bound material 1 is arranged at the top edge cutting position. At this time, the trim unit 4 (the trim cutter 20) is arranged at the stand-by position away from the top edge portion 1*a* of the bound material 1. As shown in FIG. 4A, the trim cutter 20 is arranged at the non-cutting position above the bound material 1, and the pressure member 22 is arranged at the non-pressing position above the bound material 1.

Figure 3B:
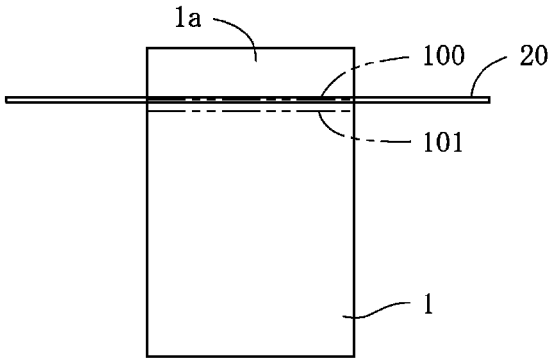
FIG. 3B is a plan view illustrating the trimming process of the trimmer according to the present invention in which the trim cutter is disposed directly above a first line.
Figure 4B:
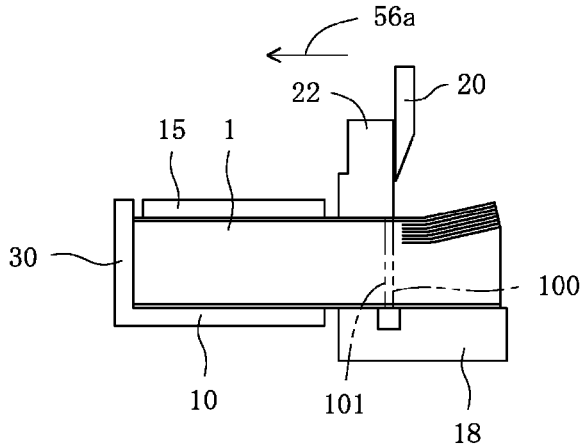
FIG. 4B is a side view illustrating the trimming process of the trimmer according to the present invention in which the trim cutter is disposed directly above the first line.

Then, as shown in FIG. 3B, the trim unit 4 (the trim cutter 20) moves in the moving direction 56*a* perpendicular to the length direction 20*a* of the trim cutter 20. The trim cutter 20 is arranged directly above the first line 100. At this time, the trim cutter 20 is arranged at the non-cutting position, and the pressure member 22 is arranged at the non-pressing position. Then, as shown in FIG. 4B, the pressure member 22 moves downwardly to the pressing position by the pressure member drive mechanism 23 so as to press the bound material 1 against the additional table 18. Then, the trim cutter 20 moves downwardly to the cutting position by the first drive mechanism 21 so as to press the blade edge thereof against the blade receive plate 19. Thereby, the top edge portion 1*a* of the bound material 1 is cut at the first line 100.

Then, the trim cutter 20 is moved upwardly to the non-cutting position away from the bound material 1 by the first drive mechanism 21. The pressure member 22 is moved upwardly to the non-pressing position away from the bound material 1 by the pressure member drive mechanism 23.

Figure 3C:
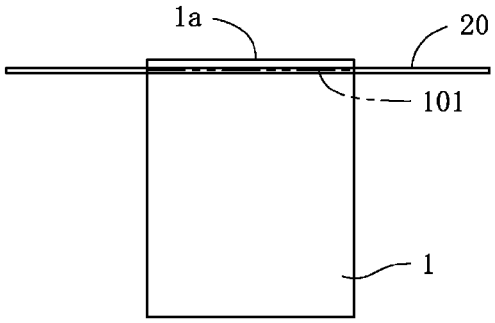
FIG. 3C is a plan view illustrating the trimming process of the trimmer according to the present invention in which the trim cutter is disposed directly above a second line.
Figure 4C:
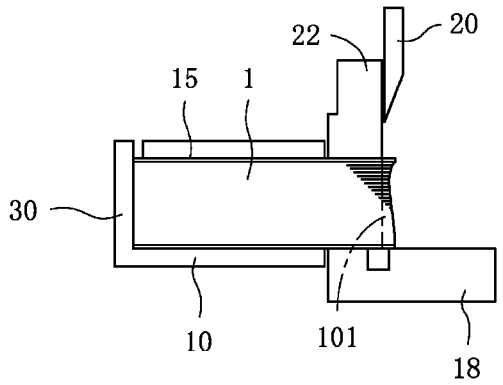
FIG. 4C is a side view illustrating the trimming process of the trimmer according to the present invention in which the trim cutter is disposed directly above the second line.

Then, as shown in FIG. 3C, the trim unit 4 (the trim cutter 20) is moved at the small interval X in the moving direction 56*a* by the second drive mechanism 56. The trim cutter 20 is arranged directly above the second line 101. At this time, the trim cutter 20 is arranged at the non-cutting position above the bound material 1, and the pressure member 22 is arranged at the non-pressing position above the bound material 1. As shown in FIG. 4C, the pressure member 22 is moved downwardly to the pressing position by the pressure member drive mechanism 23 so as to press the bound material 1 against the additional table 18. Then, the trim cutter 20 is moved downwardly to the pressing position by the first drive mechanism 21 so as to press the blade edge thereof against the blade receive plate 19. Thereby, the top edge portion 1*a* of the bound material 1 is cut at the second line 101.

The bottom edge portion 1*b* of the bound material 1 is also cut at the first and second lines 100 and 101 through the same process as above described. As a result, the width (the distance between the top and bottom edge portions 1*a* and 1*b*) of the bound material 1 becomes equal to the value inputted into the column 70*f* of the second set screen (see FIG. 5B).

Although in this embodiment the front edge portion 1*c* of the bound material 1 is cut only once ("once cut"), in another embodiment the front edge portion 1*c* of the bound material 1 can be cut at both of the first and second lines 100 and 101 ("twice cuts").

[Second Embodiment]

Figure 6:
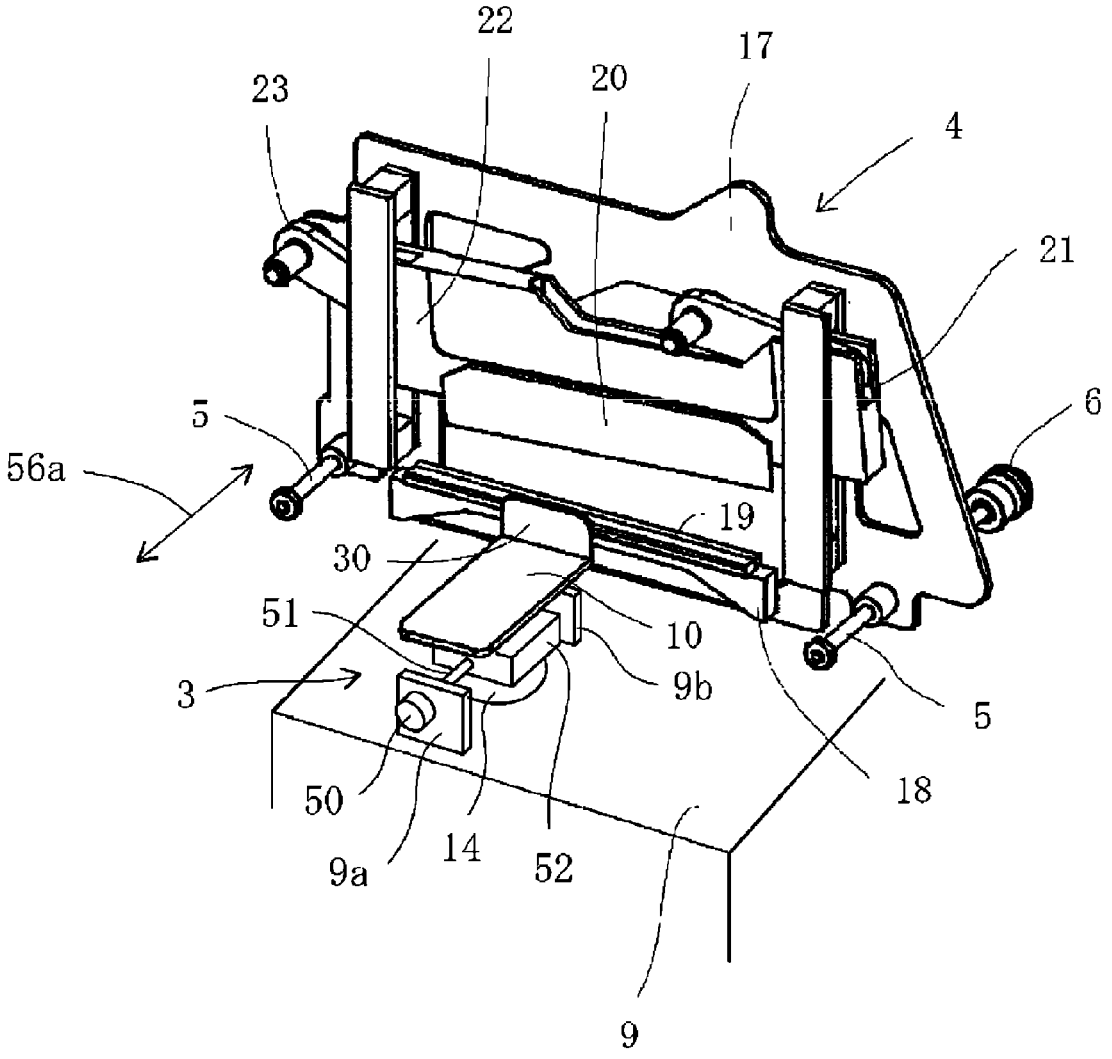
FIG. 6 is a schematic perspective view showing a structure of the trimmer according to a second embodiment of the present invention
Figure 7A:
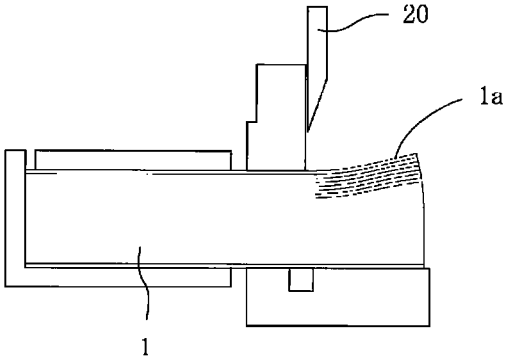
FIG. 7 is a schematic view illustrating a trimming process of a conventional trimmer.
Figure 7B:
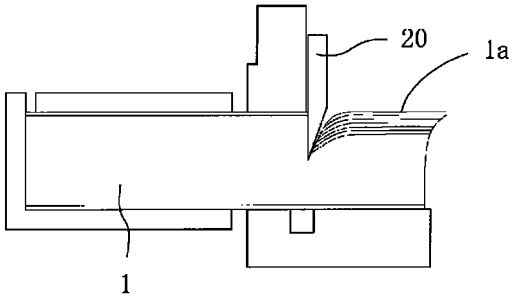
Figure 7C:
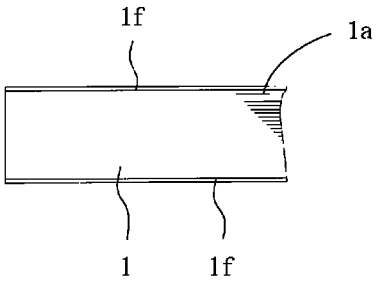
Figure 8A:
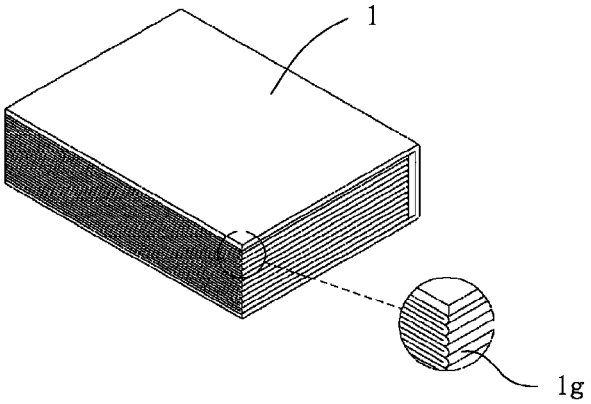
FIG. 8 is a schematic view illustrating the trimming process of the conventional trimmer.
Figure 8B:
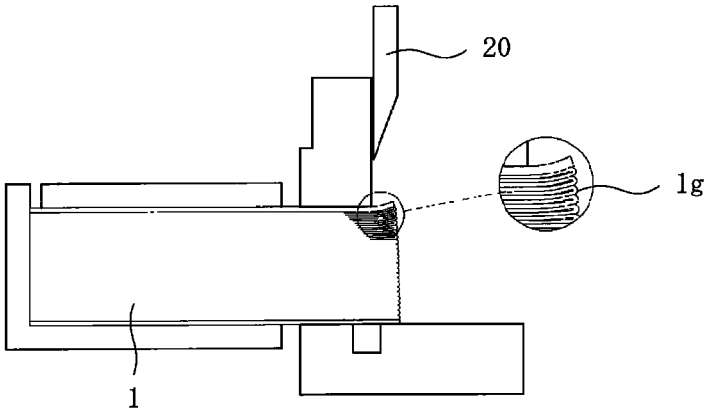
Figure 8C:
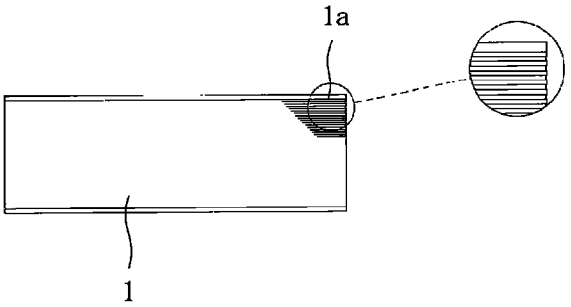

FIG. 6 is a perspective view showing a schematic structure of main elements of the trimmer of the second embodiment of the present invention. In the first embodiment, the trim cutter 20 is arranged directly above both of the first and second lines 100 and 101 of the bound material 1 by the movement of the trim unit 4 (the trim cutter 20) in the moving direction 56*a*, while in the second embodiment, the trim cutter 20 is arranged directly above both of the first and second lines 100 and 101 of the bound material 1 by the movement of the table 100, on which the bound material 1 is placed, in the moving direction 56*a*. In FIG. 5, the same numerals as those of FIG. 1 are assigned to the same components as those of FIG. 1, and detailed explanation of these elements will be omitted.

Referring to FIG. 6, in this embodiment, a shaft (not shown) of the table 10 is rotatably supported by a bearing (not shown) which is fixed to a movable block 52 in the table unit 3. The movable block 52 has a through hole provided with a thread groove. A feed screw 51 extending parallel to the moving direction 56*a* is engaged with this through hole. The feed screw 51 is mounted on the base 9 via support members 9*a* and 9*b* so as to be rotatable around its axis. Further, a motor 14 drives and rotates the shaft of the table 10. The motor 14 is fixed to the movable block 52 so as to be capable of moving with the movable block 52. Moreover, a motor 50 is fixed to the support member 9*a*, and the drive shaft of the motor 50 is coupled to the feed screw 51. The drive of the motor 50 reciprocates the movable block 52, and the shaft of the table 10 reciprocates in the horizontal moving direction 56*a*. The table 10 on which the bound material 1 is placed moves along the moving direction 56*a*. The trim cutter 20 is disposed directly above the first and second lines 100 and 101 of the bound material 1. As a result, the top and bottom edge portions 1*a* and 1*b* of the bound material 1 are cut at the first and second lines 100 and 101.

[Third Embodiment]

Each of the trimmers of the first and second embodiments is a three-side trimmer. The bound material 1 is arranged at three positions respectively, i.e., a top, front and bottom edge cutting positions by the rotation of the table 10. In the third embodiment (not shown), an operator should rotate and arrange the bound material 1 at top, front and bottom edge cutting positions by oneself. The cutting process is started after the positioning of the bound material 1 on the table 10. During the cutting process, the trim cutter 20 is arranged directly above the first line 100 so as to cut the bound material 1, then the trim unit 4 having the trim cutter 20 moves at the small interval X in the moving direction 56*a*, and then the trim cutter 20 is arranged directly above the second line 101 so as to cut the bound material 1. Thus, the trim cutter 20 automatically moves at the small interval X and performs the operation of the "twice cuts" so as to cut the top, bottom and front edge portions 1*a*, 1*b* and 1*c* at both of the first and second lines 100 and 101.

According to the first, second and third embodiments of the present invention, at first the trimmer cuts the top and bottom edge portions 1*a* and 1*b* at the first line 100. At this time, cut edges of the top and bottom edge portions 1*a* and 1*b* of the bound material 1 might be bent or torn when the bound material 1 is cut at the first line 100. Then, the trimmer further cuts the top and bottom edge portions 1*a* and 1*b* of the bound material 1 at the second line 101. Thus, the top and bottom edge portions 1*a* and 1*b* of the bound material 1 are cut at the second line 101 after cut at the first line 100. Even though the top and bottom edge portions 1*a* and 1*b* becomes bent or torn through the first cut, the bent or torn portion of the bound material 1 is removed through the second cut. Therefore, the edges of the top and bottom edge portions 1*a* and 1*b* of the bound material 1 are trimmed neatly.

In case that each of pages of the bound material 1 is an uncut page ("signature") which is half folded, the front edge portion 1*c* of the bound material 1 is cut at the first and second lines 100 and 101 by the trimmer. In this case, at first the front edge portion 1*c* of the bound material 1 at the first line 100 is cut by the trimmer. At this time, the front edge portion 1*c* of the bound material 1 is not cut neatly. Then, the front edge portion 1*c* of the bound material 1 is further cut at the second line 101 by the trimmer. Thus, the front edge portion 1*c* of the bound material 1 is cut at the second line 101 after cut at the first line 100. Even though the front edge portion 1*c* is not cut neatly through the first cut, the front edge portion 1*c* is cut neatly through the second cut.

DESCRIPTION OF THE REFERENCE CHARACTERS

1 bound material
1*a* top edge portion of the bound material
1*b* bottom edge portion of the bound material
1*c* front edge portion of the bound material
10 table
20 trim cutter
20*a* length direction of the trim cutter
21 first drive mechanism
56 second drive mechanism
56*a* moving direction of the trim cutter
5 feed screw
6 motor
7 control unit
70 touch screen
17 frame
100 first line
101 second line
X small interval

The invention claimed is:

1. A trimmer for trimming an edge portion of a bound material, comprising:

a table for supporting the bound material;

a trim cutter for cutting the edge portion of the bound material;

a frame for supporting the trim cutter;

a first drive mechanism for reciprocating the trim cutter in a vertical direction between a cutting position and a non-cutting position;

a second drive mechanism for moving the trim cutter or the table in a moving direction perpendicular to a length direction of the trim cutter; and a control unit for controlling operations of the first and second drive mechanisms;

wherein the edge portion of the bound material to be cut is long in such a manner that the edge portion is bent when the edge portion is cut by the trim cutter only once;

wherein the edge portion of the bound material is provided with first and second lines to be cut, the first and second lines are spaced at a small interval and arranged in parallel to each other;

wherein the small interval is 1 to 5 mm;

wherein the first line is arranged outside of the second line of the bound material;

wherein the control unit is configured to receive an input as to whether the bound material is to be cut once or cut twice; and wherein the control unit is configured such that when the control unit receives the input that the bound material is to be cut twice, the control unit controls the first and second drive mechanisms in such a manner that the edge portion of the bound material is cut at the first line by the trim cutter, then the trim cutter or the table is moved at the small interval in the moving direction toward the second line, and then the edge portion of the bound material is automatically cut at the second line by the trim cutter.

2. The trimmer according to claim 1, wherein the trimmer is a three-side trimmer, and rotates the table so as to position the bound material at each of top, bottom and front edge cutting positions, and cuts a top edge portion of the bound material at the top edge cutting position, a bottom edge portion of the bound material at the bottom edge cutting position and a front edge portion of the bound material at the front edge cutting position, and the control unit controls the first and second drive mechanisms in such a manner that at least the top and bottom edge portions of the bound material are cut at the first and second lines.

3. The trimmer according to claim 1, wherein the second drive mechanism moves not the table but the trim cutter in the moving direction.

4. The trimmer according to claim 3, wherein the second drive mechanism comprises a feed screw engaged with the frame and extending in the moving direction, and a motor for rotating the feed screw; and the control unit controls a rotation of the motor in such a manner that the trim cutter is positioned at the first and second lines.

5. The trimmer according to claim 1, wherein the small interval is 2 to 3 mm.

6. The trimmer according to claim 1, further comprising:

a touch screen for receiving input of a value of the small interval; wherein the control unit controls the second drive mechanism based on the value of the small interval inputted through the touch screen.

7. A method of trimming an edge portion of a bound material, comprising:

supporting the bound material on a table;

cutting the edge portion of the bound material with a trim cutter;

supporting the trim cutter on a frame;

reciprocating the trim cutter in a vertical direction between a cutting position and a non-cutting position by means of a first drive mechanism;

moving the trim cutter or the table in a moving direction perpendicular to a length direction of the trim cutter by means of a second drive mechanism;

controlling operations of the first and second drive mechanisms by means of a control unit, according to whether the control unit receives an input that the bound material is to be cut once or cut twice;

providing the edge portion of the bound material with first and second lines to be cut, the first and second lines being spaced at a small interval and arranged in parallel to each other, the small interval being 1 to 5 mm, the first line is arranged outside of the second line of the bound material; wherein the edge portion of the bound material to be cut is long in such a manner that the edge portion is bent when the edge portion is cut by the trim cutter only once; and when the control unit receives the input that the bound material is to be cut twice, cutting the edge portion of the bound material at the first line by the trim cutter, then moving the trim cutter or the table at the small interval in the moving direction toward the second line, and then automatically cutting the edge portion of the bound material at the second line by the trim cutter by means of the first and second drive mechanisms controlled by the control unit.

8. The method according to claim 7, wherein each of pages of the bound material is an uncut page, which is half folded, and folded lines of the uncut pages is cut.

* * * * *